US008454412B2

(12) United States Patent
Esenwein

(10) Patent No.: US 8,454,412 B2
(45) Date of Patent: Jun. 4, 2013

(54) HANDHELD POWER TOOL

(75) Inventor: Florian Esenwein, Uhingen-Holzhausen (DE)

(73) Assignee: Robert Bosch GmbH, Stuttgart (DE)

( * ) Notice: Subject to any disclaimer, the term of this patent is extended or adjusted under 35 U.S.C. 154(b) by 791 days.

(21) Appl. No.: 12/440,534

(22) PCT Filed: Sep. 22, 2008

(86) PCT No.: PCT/EP2008/062637

§ 371 (c)(1),
(2), (4) Date: Mar. 9, 2009

(87) PCT Pub. No.: WO2009/059839

PCT Pub. Date: May 14, 2009

(65) Prior Publication Data

US 2010/0178857 A1 Jul. 15, 2010

(30) Foreign Application Priority Data

Nov. 5, 2007 (DE) ..... 10 2007 052 684

(51) Int. Cl.
*B24B 23/02* (2006.01)

(52) U.S. Cl.
USPC ..... 451/359; 451/344; 451/357; 451/451; 451/452; 451/455; 451/457

(58) Field of Classification Search
USPC ..... 451/344, 357, 359, 451, 452, 454, 451/455; 83/544, 546; 144/251.1
See application file for complete search history.

(56) References Cited

U.S. PATENT DOCUMENTS

| | | | | |
|---|---|---|---|---|
| 1,534,302 | A * | 4/1925 | Conradson et al. | 451/143 |
| 2,292,587 | A * | 8/1942 | Terbrueggen | 74/822 |
| 4,574,532 | A * | 3/1986 | Haberle et al. | 451/451 |
| 4,924,635 | A * | 5/1990 | Rudolf et al. | 451/344 |
| 5,005,321 | A * | 4/1991 | Barth et al. | 451/359 |
| 5,163,252 | A | 11/1992 | Garner et al. | |
| 5,637,035 | A * | 6/1997 | Yee | 451/358 |
| 5,766,062 | A * | 6/1998 | Edling | 451/451 |
| 6,699,114 | B1 * | 3/2004 | Booeshaghi et al. | 451/451 |
| 6,893,334 | B1 * | 5/2005 | Stivers | 451/359 |
| 6,949,017 | B2 * | 9/2005 | Koschel et al. | 451/358 |
| 6,988,939 | B2 * | 1/2006 | Hofmann et al. | 451/344 |
| 7,175,513 | B2 * | 2/2007 | Folin | 451/359 |
| 7,311,589 | B2 * | 12/2007 | Wiker | 451/451 |
| 7,892,075 | B2 * | 2/2011 | Esenwein | 451/451 |
| 7,955,162 | B2 * | 6/2011 | Boeck et al. | 451/451 |
| 2005/0215186 | A1 | 9/2005 | Stierle et al. | |
| 2007/0117499 | A1 | 5/2007 | Chen | |

FOREIGN PATENT DOCUMENTS

| | | |
|---|---|---|
| DE | 102 35 923 | 2/2004 |
| DE | 103 43 060 | 4/2005 |
| EP | 0 322 626 | 7/1989 |

(Continued)

*Primary Examiner* — George Nguyen
(74) *Attorney, Agent, or Firm* — Michael J. Striker

(57) ABSTRACT

The invention is based on a handheld power tool, in particular a right-angle sander (10), having a gearbox (12), a flange neck (14) with a guard device (20), which device is receivable on the flange neck (14) and forms a receptacle region for a tool (18) and is rotatable in the circumferential direction (22), and having at least one detent device (24) for locking a rotary position of the guard device (20).
It is proposed that the detent device (24) is at least partially integrated with the flange neck (14) of the gearbox (12).

22 Claims, 5 Drawing Sheets

FOREIGN PATENT DOCUMENTS

Figure 1:
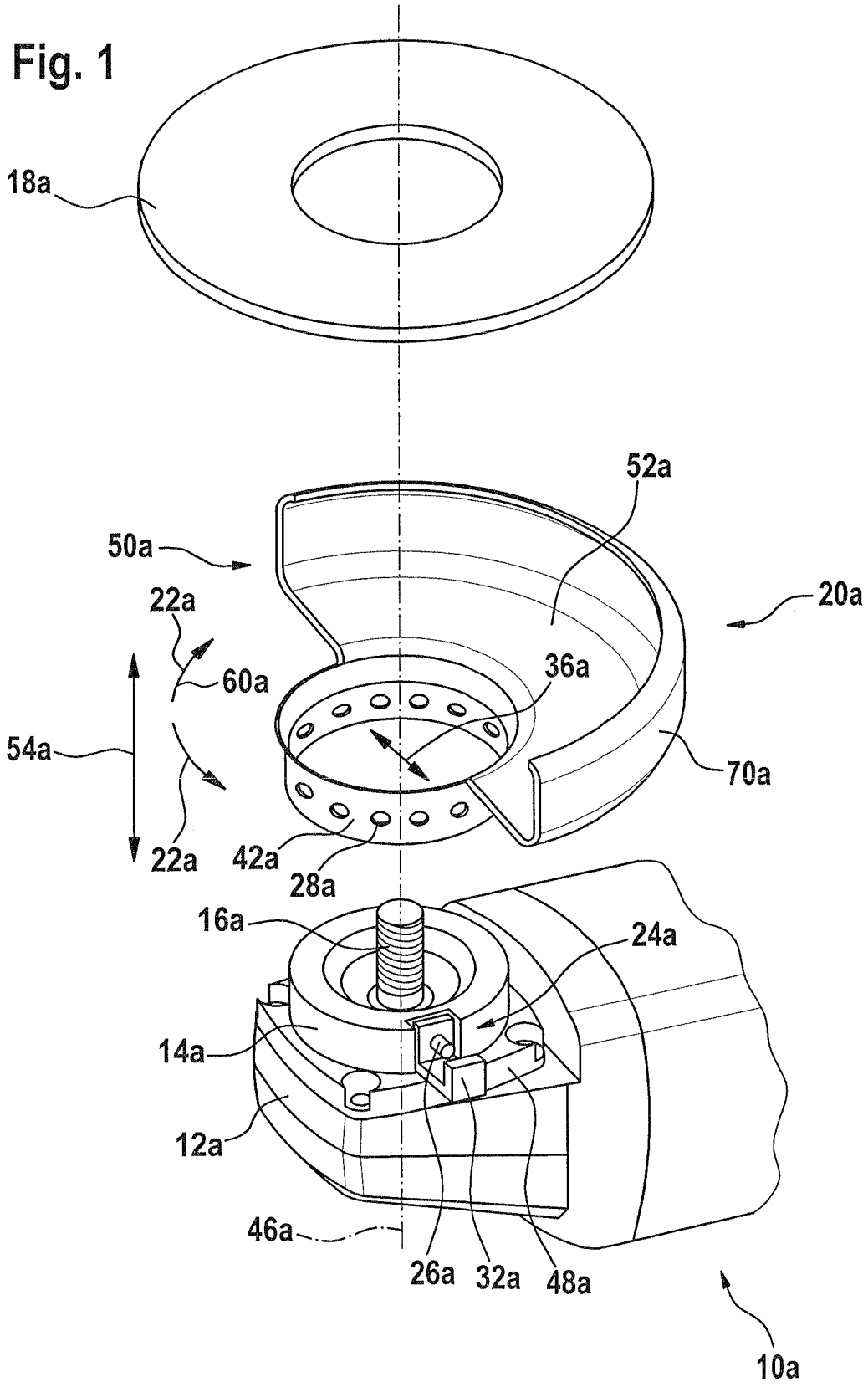

| | | |
|---|---|---|
| GB | 2 239 483 | 7/1991 |
| SU | 716792 | 2/1980 |
| SU | 1111855 | 9/1984 |

* cited by examiner

HANDHELD POWER TOOL

PRIOR ART

The invention is based on a handheld power tool as generically defined by the preamble to claim 1.

From German Patent Disclosure DE 103 43 060 A1, a handheld power tool is already known that is designed as a right-angle sander. The right-angle sander has a gearbox, with a driven shaft emerging from the gearbox and with a gear flange located on the gearbox and forming a flange neck. A guard device that is rotatable in the circumferential direction is received on the flange neck. The rotary position of the guard device in the circumferential direction can be locked with a detent lever, which in its position of repose generates a form lock with the guard device. The detent lever is located transversely to the longitudinal axis of the right-angle sander on the gearbox.

ADVANTAGES OF THE INVENTION

The invention is based on a handheld power tool, in particular a right-angle sander, having a gearbox, a flange neck with a guard device, which device can be received on the flange neck and forms a receptacle region for a tool and can be rotated in the circumferential direction, and having at least one detent device for locking a rotary position of the guard device.

It is proposed that the detent device is at least partially integrated with the flange neck, which in particular is embodied on or integrally formed onto the gearbox. The wording "integrated with the flange neck" is to be understood here in particular to mean located inside the flange neck, received in the flange neck, fitted into the flange neck, and/or embodied in one piece with the flange neck. This makes it possible to use the space that already exists in the gearbox or in the flange neck. In addition, a majority of the components of the detent device are protected against dust and damage in the gearbox or in the flange neck, since for the most part the components are surrounded by the receiving collar of the guard device. Locking that reliably prevents the guard device from being rotated out of a defined position of over 90° is assured. Advantageously, very simple user operation of the detent device is possible without a tool.

It is proposed that the locking is effected radially, beginning at the flange neck toward the guard device. This is to be understood in particular to mean that the locking motion or the motion of the detent device is effected radially, or in other words that the motion is executed in the radial direction. Advantageously, the majority of the detent device can thus be integrated with the flange neck.

Advantageously, the locking of the guard device is effected axially as well. Thus the guard device is secured not only radially but also axially against rotation or displacement. This should be understood in particular to mean that the locking can also be effected in some other direction than the axial direction yet nevertheless acts in the axial direction.

It is furthermore proposed that the locking is effected via a form lock between the detent device and the guard device. As a result, an especially secure locking of the guard device on the flange neck is assured.

One possibility of implementing the form lock in a way that is very simple to produce provides that the detent device includes at least one detent element and at least one detent element receptacle cooperating with the detent element.

It is proposed that the detent element receptacle is embodied on the guard device, as a result of which simple production of the guard device is attainable.

Advantageously, in the unlocked state, the detent element is located in the flange neck, and as a result the guard device can be rotated and repositioned on the flange neck. The term "located" should be understood in particular to mean "accommodated" or "received".

Alternatively to this, it is proposed that a plurality of detent elements are embodied on the guard device. The axial securing of the guard device is improved as a result, since these detent elements are guided all the way around in a groove in the flange neck, thereby preventing the guard device from slipping off axially.

One way of implementing the detent element receptacle in an especially simply produced and space-saving way provides that the detent element receptacle is a recess or an indentation.

It is proposed that the detent device has at least one sprina device, as a result of which, advantageously automatically, a durable form lock is generated between the guard device and the detent device and can be released at any time, preferably manually and with little expenditure of force.

Because the spring device acts upon the detent device, beginning at the flange neck, toward the guard device, the use of the space already present in the gearbox or in the flange neck is possible. In addition, the spring device is protected in the gearbox or in the flange neck from dirt and damage, since the gearbox and the flange neck are surrounded by the receiving collar of the guard device.

To make a space-saving detent device possible that is easy to install and use, it is proposed that the detent element and/or the detent element receptacle is located on a detent slide. Alternatively, it is proposed that the detent element and/or the detent element receptacle is located on a detent lever. As a result, it is possible to release the form lock between the guard device and the flange neck resulting from the lever action with very little expenditure of force.

It is furthermore proposed that the detent slide and/or the detent lever is designed such that the guard device rests flush on the gearbox, thereby making problem-free rotation and repositioning of the guard device on the flange neck possible.

It is proposed that the detent lever can be rotated about an axis located in the flange neck, as a result of which it is possible to use the already existing space in the gearbox or the flange neck for the detent device.

It has proved especially expedient that the release of the locking is effected via pressing of the detent slide and/or the detent lever.

Alternatively, releasing the locking can be done by pulling the detent lever.

To achieve greater stability of the right-angle sander and in particular of the guard device, a stabilizing neck is provided, which at least partly surrounds a receiving collar of the guard device.

Advantageously, the stabilizing neck has at least one detent element and/or at least one detent element receptacle. As a result, it is possible for the detent element to engage not only the guard device or the receiving collar of the guard device but also the stabilizing neck, so that an even higher force flow from the guard device to the flange neck or the gearbox is made possible.

It has proved especially expedient if the stabilizing neck has a tightening device, since as a result any play between the stabilizing neck and the guard device can be compensated for.

DRAWINGS

Further advantages will become apparent from the ensuing description of the drawings. In the drawings, an exemplary embodiment of the invention is shown. The drawings, specification and claims include numerous characteristics in combination. One skilled in the art will expediently consider the characteristics individually as well and put them together to make useful further combinations.

Figure 2:
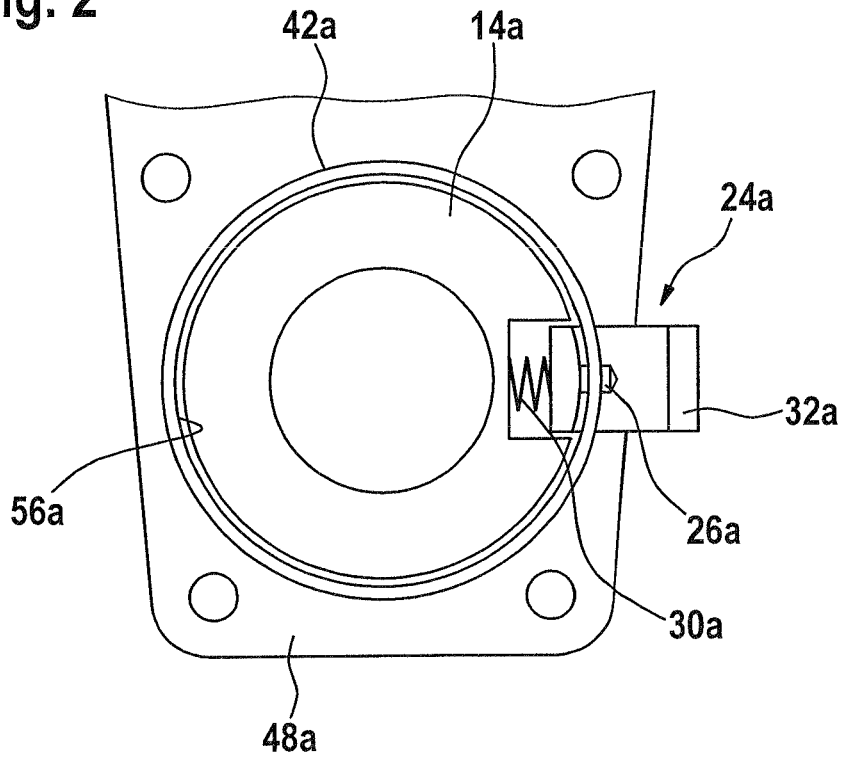
Figure 3:
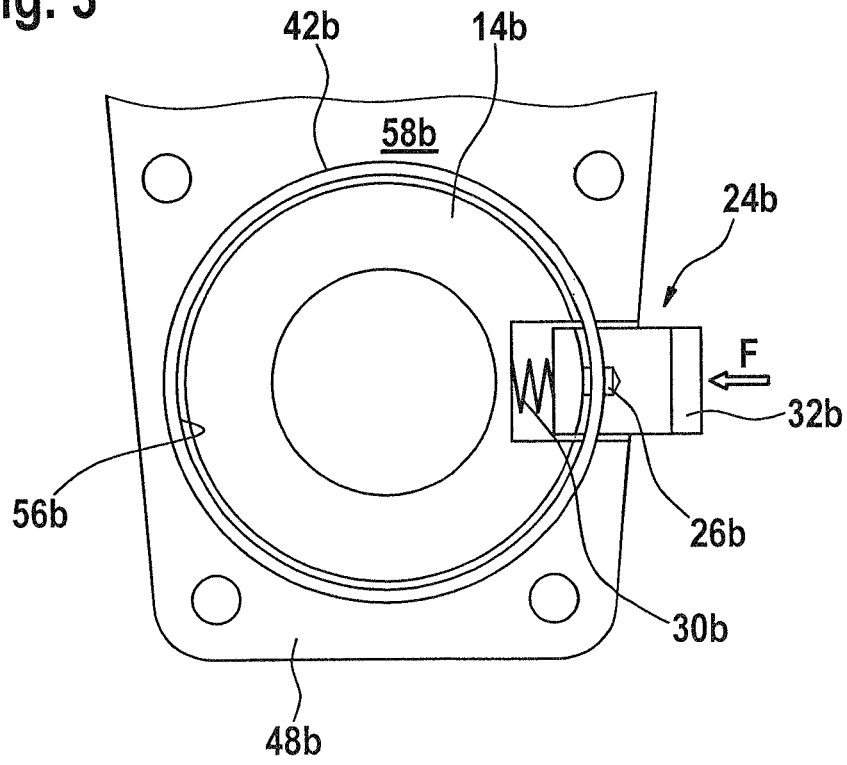
Figure 4:
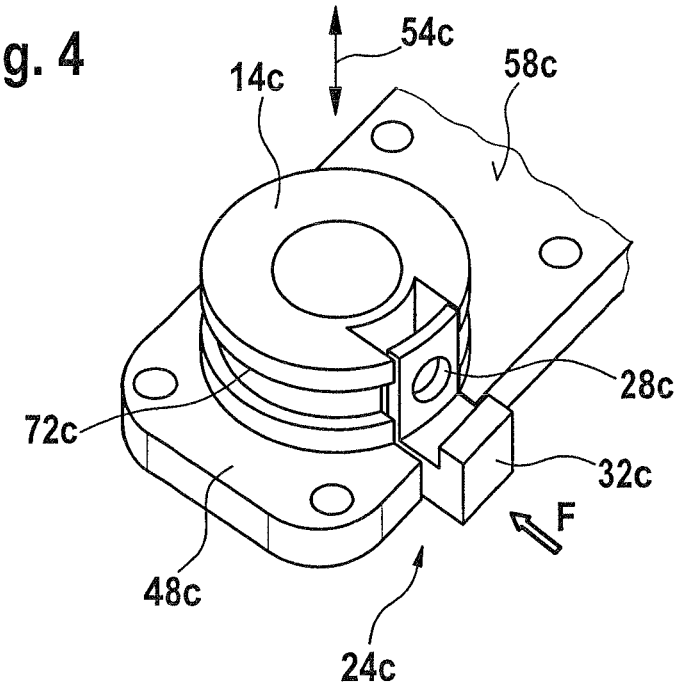
Figure 5:
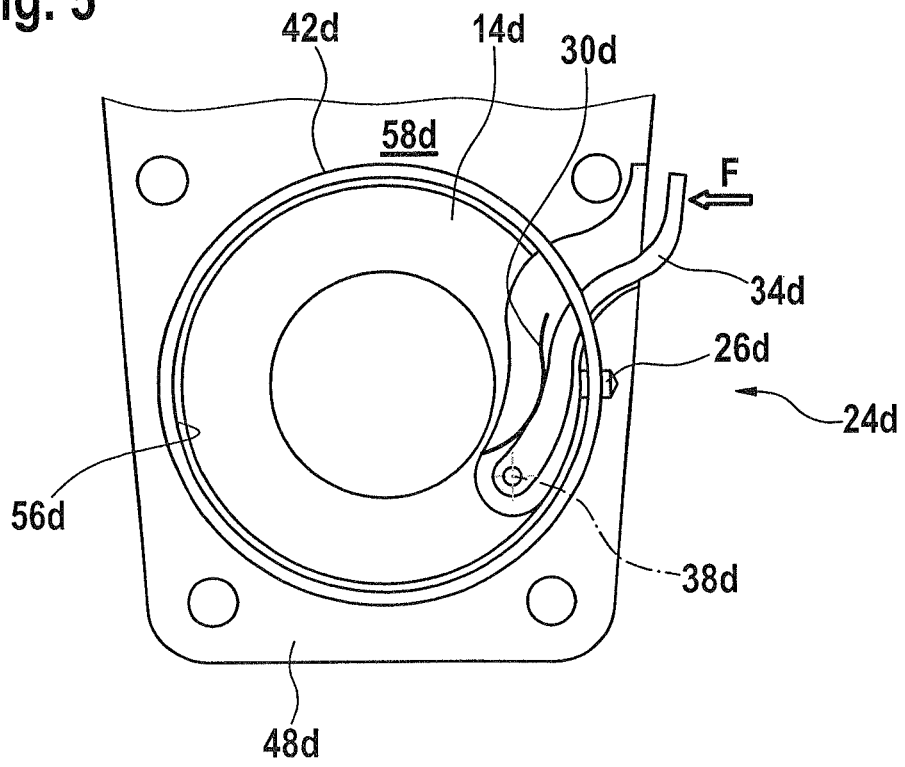
Figure 6:
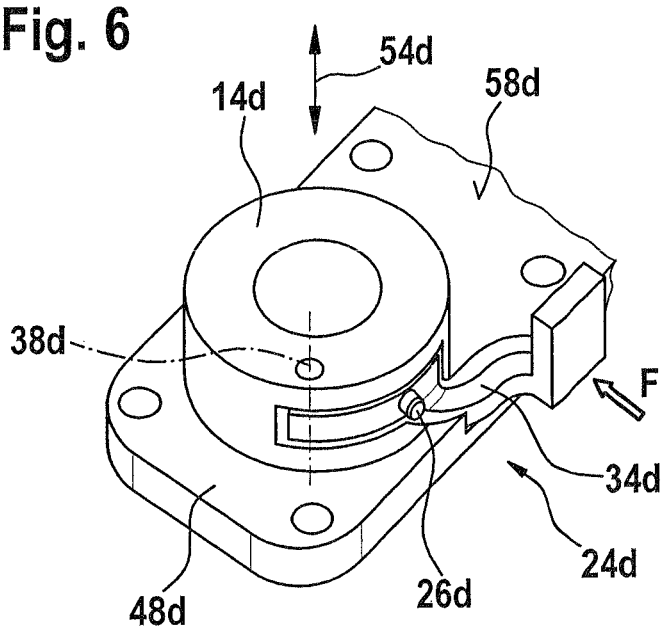
Figure 7:
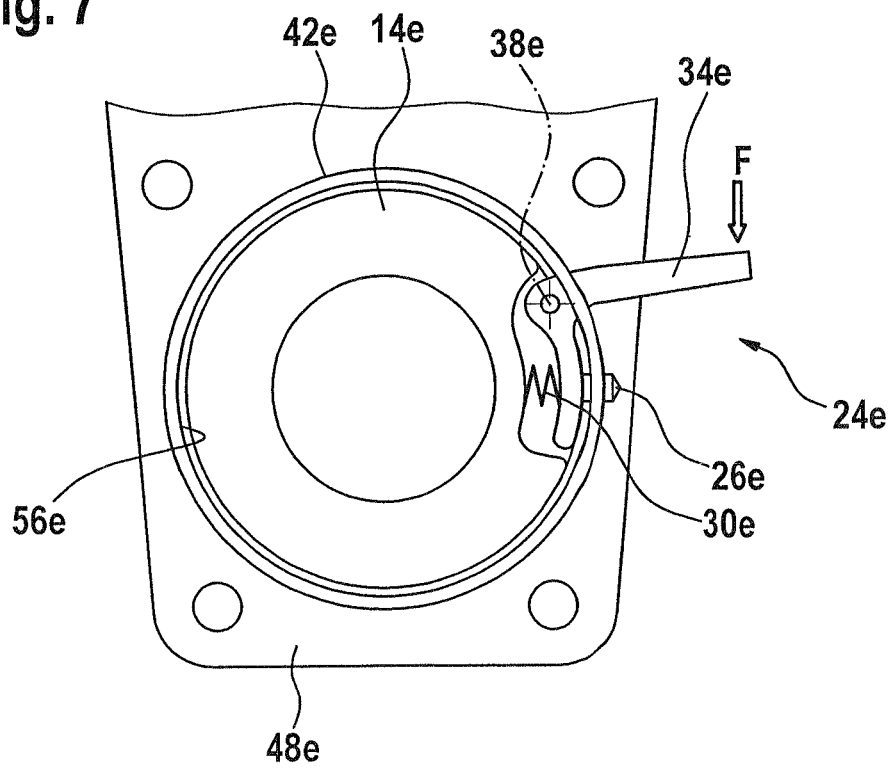
Figure 8:
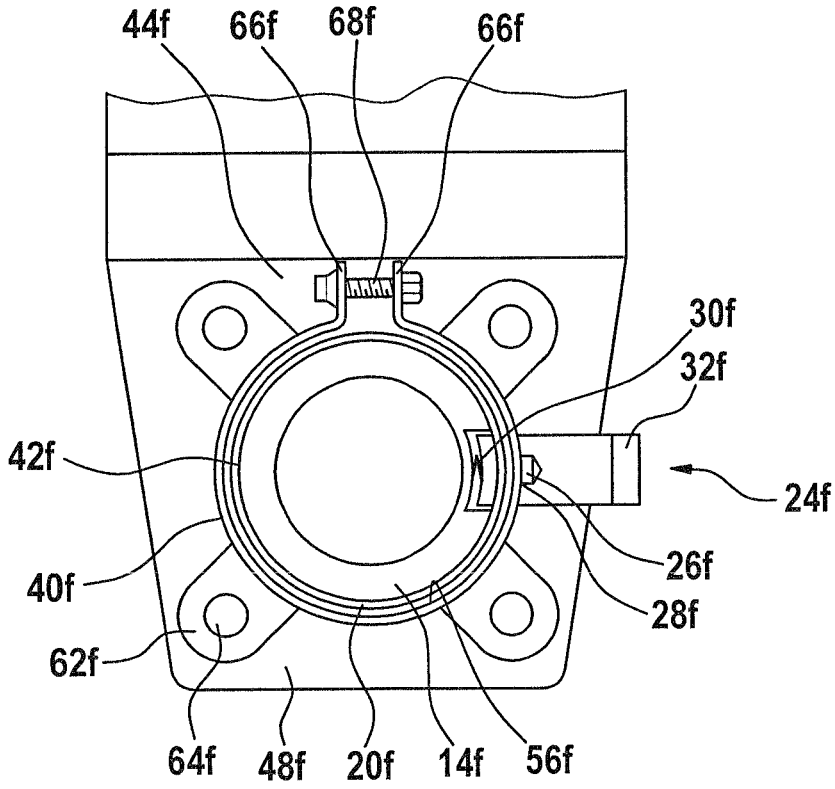

Shown are:

FIG. 1, part of a handheld power tool in an exploded view, with a guard hood and with a detent device according to the invention, in a first embodiment;

FIG. 2, a plan view on the gear flange of the handheld power tool, having the detent device of the invention, in a first embodiment;

FIG. 3, a top view on a gear flange of a handheld power tool, with a detent device of the invention, in a second embodiment;

FIG. 4, a perspective view of part of a detent device of the invention, in a third embodiment;

FIG. 5, a plan view on the gear flange of the handheld power tool, having the detent device of the invention, in a fourth embodiment;

FIG. 6, a perspective view of part of a detent device of the invention, in the fourth embodiment;

FIG. 7, a plan view on the gear flange of the handheld power tool, having the detent device of the invention, in a fifth embodiment; and FIG. 8, a plan view on the gear flange of the handheld power tool, having the detent device of the invention, in a sixth embodiment.

DESCRIPTION OF THE EXEMPLARY EMBODIMENTS

FIG. 1 shows part of a handheld power tool. In the present exemplary embodiments, the handheld power tool is a right-angle sander 10. The right-angle sander 10 has a gearbox 12. A driven shaft 16 protrudes from the gearbox 12 and on its free end has a disklike tool 18, such as a sanding wheel that is driven to rotate about an axis 46 of the driven shaft 16. The driven shaft 16 is rotatably supported in a bearing, not visible here, which in the present exemplary embodiments is received by a gear flange 48 embodied by the gearbox 12. The gearbox 12 forms a freely protruding, cylindrical flange neck 14, which adjoins the gear flange 48 and fits around the driven shaft 16.

The flange neck 14, on its outer circumference, receives a guard device, in the form of a guard hood 20. The guard hood 20 includes a base body 50 and a receiving collar 42, which is joined to the base body 50 and forms a central opening for free passage through it of the driven shaft 16. The receiving collar 42 is embodied as a cylindrical body that extends parallel to the flange neck 14. The base body 50 is provided for protecting a user of the handheld power tool against sparks and/or particles of material that occur during the operation of the handheld power tool. To that end, the base body 50 is formed by a platelike element 52, which has a semicircular embodiment, and the platelike element 52 covers an angular range of approximately 180° of the tool 18. As a result, sparks and/or any particles of material are carried toward the front, away from the user. A guard rim 70 is located on the platelike element 52 and is oriented initially at right angles to the platelike element 52 and then parallel to the platelike element 52.

The guard hood 20 is fitted with the receiving collar 42 onto the flange neck 14 and should have only little play on the flange neck 14. Optionally, via a compensation element, such as a rubber ring, not shown here, the play between the guard hood 20 and the flange neck 14 can be eliminated, at least partially. For readjusting the diameter of the receiving collar 42, for instance in order to compensate for wear, the receiving collar 42 of the guard hood 20 may furthermore be embodied as a kind of clamping cuff, with the readjustment being effected by way of tightening a screw.

The guard hood 20 is rotatable in the circumferential direction 22 on the flange neck 14. For locking a rotary position of the guard hood 20, or in other words for radially locking the guard hood 20 on the flange neck 14, a detent device 24 is provided as shown in FIGS. 1 through 8. According to the invention, the detent device 24 is integrated at least partially with the flange neck 14 of the gear flange 48. In the present exemplary embodiments, a majority of the components of the detent device 24 are integrated with the flange neck 14, and these components are surrounded there by the receiving collar 42 of the guide hood 20.

In the present exemplary embodiments in FIGS. 1 through 8, the locking is effected radially, beginning at the flange neck 14, toward the guard hood 20. Preferably, the locking of the guard hood 20 is effected via a form lock between the detent device 24 and the guard hood 20. The detent device 24 here includes at least one detent element 26 and at least one detent element receptacle cooperating with the detent element 26; the detent element is preferably a bolt 26, and the detent element receptacle is a recess 28 or an indentation. The detent device 24 has at least one spring device 30, which beginning at the flange neck 14 urges the detent device 24 toward the guard hood 20.

To secure the guard hood axially on a handheld power tool, an additional axial securing means is typically provided. As a rule, these are pins, provided in the receiving collar of the guard hood, which engage an encompassing groove 72 in the flange neck. This additional locking can be dispensed with because of the detent device 24 of the invention. In the present case, the locking according to the invention acts, in addition to a radial direction 36, in an axial direction 54 as well. However, one skilled in the art may nevertheless provide an additional axial securing means, if that appears useful to him.

FIGS. 1 through 8 show a plurality of exemplary embodiments of the invention. In FIGS. 1 through 4, the detent device 24*a* through 24*c* is embodied as a detent slide 32*a* through 32*c*, and in FIGS. 5 through 7, the detent device 24*d* through 24*f* is embodied as a detent lever 34*d* through 34*f*. The detent element 26*a* through 26*f* of the detent device 24*a* through 24*f* may be embodied on the guard hood 20*a* through 20*f* or on the detent slide 32*a* through 32*f* or on the detent lever 34*a* through 34*f*, and the detent element receptacle 28*a* through 28*f* may be embodied on the detent slide 32*a* through 32*f* or on the detent lever 34*a* through 34*f* or on the guard hood 20*a* through 20*f*.

FIGS. 1 through 4 show a gear flange 48*a* through 48*c* with an integrated detent slide 32*a* through 32*c* in the locked state, in which the detent slide 32*a* through 32*c* is in engagement with the guard hood 20*a* through 20*c*; that is, in the present exemplary embodiments in FIGS. 1 through 3, a bolt 26*a*, 26*b* is embodied on the detent slide 32*a*, 32*b* and in the locked state of the detent device 24*a*, 24*b* engages a recess 28*a*, 28*b* of the receiving collar 42*a*, 42*b* of the guard hood 20*a*, 20*b*. Conversely, in FIG. 4, it is also possible to provide a recess 28*c* on the detent slide 32*c* and a bolt 26*c* on the guard hood 20*c*. It is moreover possible to provide a plurality of bolts 26*a* through 26*c* and recesses 28*a* through 28*c* on the detent slide 32*a* through 32*c* and on the guard hood 20*a* through 20*c*, respectively, in order to enable a greater flow of force from the flange neck 14*a* through 14*c* to the guard hood 20*a* through 20*c*. During locking, the detent slide 32*a* through 32*c* is displaced with the bolt 26*a* through 26*c* in the radial direction 36, in that by way of the spring device 30*a* through 30*c*, embodied for instance as a compression spring, the detent slide is pressed against an inner wall 56*a* through 56*c* of the receiving collar 42*a* through 42*c* of the guard hood 20*a* through 20*c*. Next, the guard hood 20*a* through 20*c* is rotated in the circumferential direction 22*a* through 22*c* until such time as the bolt 26*a* through 26*c* and a recess 28*a* through 28*c* in the receiving collar 42*a* through 42*c* are diametrically opposite one another and the bolt 26*a* through 26*c*, by the force of the spring device 30*a* through 30*c*, moves into the recess 28*a* through 28*c* and thereby generates a form lock between the flange neck 14*a* through 14*c* and the guard hood 20*a* through 20*c*. To release the form lock and to attain the unlocked state, the detent slide 32*a* through 32*c* merely has to be pressed in the radial direction 36*a* through 36*c* into the flange neck 14*a* through 14*c* counter to the force of the spring device 30*a* through 30*c*, so that the bolt 26*a* through 26*c* becomes disengaged, or in other words so that the detent element 26*a* through 26*c* embodied as a bolt is located in the flange neck 14*a* through 14*c*. In the unlocked state of the detent device 24*a* through 24*c*, the guard hood 20*a* through 20*c* can now be rotated and repositioned on the flange neck 14*a* through 14*c*.

FIGS. 3 and 4 show that the detent slide 32*b*, 32*c* is designed such that the guard hood 20*b*, 20*c* rests with its receiving collar 42*b*, 42*c* flush on the gear flange 48*b*, 48*c*. This is attained by providing that the detent slide 32*b*, 32*c* is let axially into the gear flange 48*b*, 48*c*, as a result of which a flat bearing face 58*b*, 58*c* in the axial direction 54*b*, 54*c* is created for the receiving collar 42*b*, 42*c* of the guard hood 20*b*, 20*c*.

FIGS. 5 through 7 show a gear flange 48*d* through 48*f* with an integrated detent lever 34*d* through 34*f* in the locked state, in which the detent lever 34*d* through 34*f* is in engagement with the guard hood 20*d* through 20*f*; that is, in the present exemplary embodiment, a bolt 26*d* through 26*f* which in the locked state of the detent device 24*d* through 24*f* engages a recess 28*d* through 28*f* of the receiving collar 42*d* through 42*f* of the guard hood 20*d* through 20*f* is embodied on the detent lever 34*d* through 34*f*. Conversely to this, it is also possible to provide a recess 28*d* through 28*f* on the detent lever 34*d* through 34*f* and a bolt 26*d* through 26*f* on the guard hood 20*d* through 20*f*. It is furthermore also possible to provide a plurality of bolts 26*d* through 26*f* and recesses 28*d* through 28*f* on the detent lever 34*d* through 34*f* and on the guard hood 20*d* through 20*f*, respectively, in order to enable a greater flow of force from the flange neck 14*d* through 14*f* to the guard hood 20*d* through 20*f*. The detent lever 34*d* through 34*f* is rotatable about an axis 38*d* through 38*f* that is located in the flange neck 14*d* through 14*f*. During locking, the detent lever 34*d* through 34*f* is rotated with the bolt 26*d* through 26*f* about the axis 38*d* through 38*f*, in that, via the spring device 30*d* through 30*f*, embodied for instance as a leaf spring, the detent lever is pressed against an inner wall 56*d* through 56*f* of the receiving collar 42*d* through 42*f* of the guard hood 20*d* through 20*f*. Next, the guard hood 20*d* through 20*f* is rotated in the circumferential direction 22*d* through 22*f* until such time as the bolt 26*d* through 26*f* and a recess 28*d* through 28*f* in the receiving collar 42*d* through 42*f* are diametrically opposite one another, and the bolt 26*d* through 26*f*, by the force of the spring device 30*d* through 30*f*, moves into the recess 28*d* through 28*f* and thereby creates a form lock between the flange neck 14*d* through 14*f* and the guard hood 20*d* through 20*f*. In other words, by way of the spring device 30*d* through 30*f*, the detent lever 34*d* through 34*f* is always automatically put into engagement whenever the bolt 26*d* through 26*d* and the recess 28*d* through 28*f* are diametrically opposite one another, and no force is being exerted on the detent lever 34*d* through 34*f*. Advantageously, the detent lever 34*d* upon rotation of the guard hood 20*d*, in the present exemplary embodiment of FIGS. 5 and 6, in the clockwise direction 60*d* becomes more and more tightly clamped, so that self-locking of the detent lever 34*d* occurs. Depending on the design of this detent device 24*d*, it is possible for rotation of the detent lever 34*d* counter to the clockwise direction 60*d*, for the bolt 26*d* to be pressed out of the recess 28*d* in the guard hood 20*d*, thus making overlocking possible, for instance to enable a quick adjustment of the guard hood 20*d* in one direction.

To release the form lock and to attain the unlocked state, the detent lever 34*d* through 34*f* merely has to be pressed in the direction of the flange neck 14*d* through 14*f*, counter to the force of the spring device 30*d* through 30*f*, so that the bolt 26*d* through 26*f* becomes disengaged, or in other words the detent element 26*d* through 26*f*, embodied as a bolt, is located in the flange neck 14*d* through 14*f*. In the unlocked state of the detent device 24*d* through 24*f*, the guard hood 20*d* through 20*f* can now be rotated and repositioned on the flange neck 14*d* through 14*f*.

FIGS. 5 and 6 show that the detent lever 34*d* is designed such that the guard hood 20*d*, with its receiving collar 42*d*, can rest flush on the gear flange 48*d*. This is attained by providing that the detent lever 34*d* is let axially into the gear flange 48*d*, thereby creating a flat bearing face 58*d* for the receiving collar 42*d* of the guard hood 20*d* in the axial direction 54*d*.

Besides the position of the axis of rotation 38 for the detent lever variant described, still other positions of the axis of rotation 38 that appear useful to one skilled in the art can be imagined that make it possible to disengage the bolt. In FIG. 7, for instance, the detent device 24*e* is designed such and the axis of rotation 38*e* is positioned such that for releasing the form lock and attaining the unlocked state, the detent lever 34*e* must be pulled in the direction of the flange neck 14*e*, counter to the force of the spring device 30*e*, so that the bolt 26*e* becomes disengaged, or in other words so that the detent element 26*e* embodied as a bolt is located in the flange neck 14*e*.

It is also possible to provide a plurality of detent slides 32 and/or detent levers 34 in a handheld power tool 10, so that for instance one detent slide 32 is provided on the right and one detent slide 32 on the left of the handheld power tool 10. When the two detent slides 32 embrace the machine 10 from above and are actuated, the guard hood 20 is released to rotate. Both for the detent slide 32 and for the detent lever 34, it is provided that by way of the displacement of the detent slide 32 or the pressing or pulling the detent lever 34, the form lock between the guard hood 20 and the detent device 24 is released, so that no additional tool is needed for adjusting the guard hood 20. However, it is also conceivable that for instance via a screw, not shown here, a feeding means is created, which is mounted on the detent slide 32 or the detent lever 34, by which the bolt 26 is then disengaged.

FIG. 8 shows a further variant embodiment of the right-angle sander 10*f* with a stabilizing neck 40*f*. FIG. 8 shows the gear flange 48*f* with the flange neck 14*f* that receives the guard hood 20*f* on its outer circumference. In this embodiment of the invention, the stabilizing neck 40*f* is additionally provided, which at least partly surrounds the receiving collar 42*f* of the guard hood 20*f*. The stabilizing neck 40*f* may be advantageously secured to the gear flange 48*f* via securing means 62*f*; as the securing means 62*f*, any means appearing useful to one skilled in the art can be employed. In the present exemplary embodiment, the stabilizing neck 40*f* for the securing has securing feet 62*f*, which are connected to the gear flange 48*f* via screw connections 64*f*. To compensate for play between the stabilizing neck 40*f* and the guard hood 20*f*, the stabilizing neck 40*f* has a tightening device 44*f*, which can also additionally be provided as a securing means. In the present case, two angled ends 66*f* of the stabilizing neck 40*f* serve as the tightening device 44*f* and can be tightened against one another via a screw 68*f*. The stabilizing neck 40*f* has at least one detent element 26*f* and/or at least one detent element receptacle 28*f*.

The invention claimed is:

1. A handheld power tool, comprising a gearbox (12), a flange neck (14) with a guard device (20), wherein the guard device (20) is receivable on the flange neck (14), forms a receptacle region for a tool (18) and is rotatable in the circumferential direction (22), and at least one detent device (24) for locking a rotary position of the guard device (20), wherein the detent device (24) is at least partially integrated with the flange neck (14), and wherein the locking is effected radially, beginning at the flange neck (14) toward the guard device (20).

2. The handheld power tool as defined by claim 1, characterized in that the locking of the guard device (20) acts axially as well.

3. The handheld power tool as defined by claim 1, characterized in that the locking is effected via a form lock between the detent device (24) and the guard device (20).

4. The handheld power tool as defined by claim 1, characterized in that the detent device (24) includes at least one detent element (26) and at least one detent element receptacle (28) cooperating with the detent element (26).

5. The handheld power tool as defined by claim 4, characterized in that the detent element receptacle (28) is embodied on the guard device (20).

6. The handheld power tool as defined by claim 5, characterized in that in the unlocked state, the detent element (26) is located in the flange neck (14).

7. The handheld power tool as defined by claim 4, characterized in that a plurality of detent elements (26) are embodied on the guard device (20).

8. The handheld power tool as defined by claim 4, characterized in that the detent element receptacle is a recess (28) or an indentation.

9. The handheld power tool as defined by claim 1, characterized in that the detent device (24) has at least one spring device (30).

10. The handheld power tool as defined by claim 9, characterized in that the spring device (30) acts upon the detent device (24), beginning at the flange neck (14), toward the guard device (20).

11. The handheld power tool as defined by claim 4, characterized in that the detent element (26) and/or the detent element receptacle (28) is located on a detent slide (32) and/or on a detent lever (34).

12. The handheld power tool as defined by claim 11, characterized in that the detent slide (32) is displaceable in the radial direction (36).

13. The handheld power tool as defined by claim 11, characterized in that the detent slide (32) and/or the detent lever (34) is designed such that the guard device (20) rests flush on the gearbox (12).

14. The handheld power tool as defined by claim 11, characterized in that the detent lever (34) is rotatable about an axis (38) located in the flange neck (14).

15. The handheld power tool as defined by claim 11, characterized in that the release of the locking is effected via pressing of the detent slide (32) and/or the detent lever (34).

16. The handheld power tool as defined by claim 11, characterized in that the release of the locking is effected via pulling of the detent lever (34).

17. The handheld power tool as defined by claim 1, characterized by a stabilizing neck (40), which at least partly surrounds a receiving collar (42) of the guard device (20).

18. The handheld power tool as defined by claim 17, characterized in that the stabilizing neck (40) has at least one detent element (26) and/or at least one detent element receptacle.

19. The handheld power tool as defined by claim 17, characterized in that the stabilizing neck (40) has a tightening device (44).

20. The handheld power tool as defined by claim 1, wherein the handheld power tool embodies a right-angle sander.

21. A handheld power tool, comprising a gearbox (12), a flange neck (14) with a guard device (20), wherein the guard device (20) is receivable on the flange neck (14), forms a receptacle region for a tool (18) and is rotatable in the circumferential direction (22), and at least one detent device (24) for locking a rotary position of the guard device (20), wherein the detent device (24) is at least partially integrated with the flange neck (14), and wherein the detent device (24) comprises at least one spring device (30) that is effected radially, beginning at the flange neck (14) toward the guard device (20).

22. A handheld power tool, comprising a gearbox (12), a flange neck (14) with a guard device (20), wherein the guard device (20) is receivable on the flange neck (14), forms a receptacle region for a tool (18) and is rotatable in the circumferential direction (22), and at least one detent device (24) for locking a rotary position of the guard device (20), wherein the detent device (24) is at least partially integrated with the flange neck (14), and wherein the detent device (24) comprises at least one detent slide (32), at least one detent lever (34) or both, deflectable in a radial direction.

* * * * *